US007802563B2

(12) United States Patent
Behr et al.

(10) Patent No.: US 7,802,563 B2
(45) Date of Patent: Sep. 28, 2010

(54) AIR/FUEL IMBALANCE MONITOR USING AN OXYGEN SENSOR

(75) Inventors: Ken John Behr, Farmington Hills, MI (US); Has R Patel, Canton, MI (US); Michael Igor Kluzner, Oak Park, MI (US); Bob Roy Jentz, Westland, MI (US)

(73) Assignee: Fors Global Technologies, LLC, Dearborn, MI (US)

( * ) Notice: Subject to any disclaimer, the term of this patent is extended or adjusted under 35 U.S.C. 154(b) by 266 days.

(21) Appl. No.: 12/055,111

(22) Filed: Mar. 25, 2008

(65) Prior Publication Data

US 2009/0241925 A1 Oct. 1, 2009

(51) Int. Cl.
*F02D 41/00* (2006.01)
*F02D 41/14* (2006.01)

(52) U.S. Cl. ..... 123/692; 701/109

(58) Field of Classification Search ..... 123/692, 123/703, 690, 672; 701/109; 60/276
See application file for complete search history.

(56) References Cited

U.S. PATENT DOCUMENTS

| | | | | |
|---|---|---|---|---|
| 5,131,372 | A | 7/1992 | Nakaniwa | |
| 5,524,598 | A | 6/1996 | Hasegawa et al. | |
| 5,542,404 | A | 8/1996 | Hasegawa et al. | |
| 5,730,111 | A | 3/1998 | Kaji et al. | |
| 5,915,368 | A | 6/1999 | Ishida et al. | |
| 6,382,198 | B1 * | 5/2002 | Smith et al. | 123/673 |
| 6,494,038 | B2 | 12/2002 | Kobayashi et al. | |
| 6,497,228 | B1 * | 12/2002 | Booth et al. | 123/692 |
| 6,550,466 | B1 * | 4/2003 | Behr et al. | 123/692 |
| 7,146,851 | B2 * | 12/2006 | Wakahara et al. | 73/114.72 |
| 7,234,455 | B2 * | 6/2007 | Pallett et al. | 123/692 |
| 7,483,781 | B2 | 1/2009 | Wakahara et al. | |

* cited by examiner

*Primary Examiner*—Mahmoud Gimie
(74) *Attorney, Agent, or Firm*—Julia Voutyras; Alleman Hall McCoy Russell & Tuttle LLP

(57) ABSTRACT

Air/fuel imbalance monitoring systems and methods for monitoring air/fuel ratio imbalance of an internal combustion engine are disclosed. In one embodiment, an oxygen sensor is sampled above cylinder firing frequency and a ratio of data from at least one window over a total number of windows is determined. The approach can be used to indicate imbalances between engine cylinders.

20 Claims, 12 Drawing Sheets

AIR/FUEL IMBALANCE MONITOR USING AN OXYGEN SENSOR

BACKGROUND AND SUMMARY

Applicants have recognized that cylinder-cylinder air/fuel ratio imbalances may occur due to cylinder-to-cylinder variation in intake valve depositions, plugged EGR orifices, and/or shifted fuel injectors.

While various approaches have been set forth for individual cylinder air-fuel control, with the aim at reducing cylinder-cylinder air-fuel ratio variation, such variation may persist. As such, air/fuel imbalance monitoring systems and methods for monitoring air/fuel ratio imbalance of an internal combustion engine having a plurality of engine cylinders are provided herein. An example of the method may include routing exhaust gas from a first group of cylinders to an exhaust gas oxygen sensor, and during selected operating conditions, indicating that air/fuel of at least one cylinder in the first group is imbalanced based on a response of the exhaust gas oxygen sensor at frequencies at or above firing frequency of the cylinders in the first group. An example of the system may include an exhaust gas oxygen sensor positioned in such a way that exhaust gas from the group of engine cylinders are routed to the exhaust gas oxygen sensor, and a controller configured to during selected operating conditions, indicate that air/fuel of at least one cylinder in the group is imbalanced based on a response of the exhaust gas oxygen sensor at frequencies at or above firing frequency of the cylinders in the group. In one particular example, the group of cylinders may be a sub-set of the cylinders in the engine, where the exhaust gas oxygen sensor receives exhaust gas only from the cylinder sub-set.

By basing the indication of air-fuel ratio imbalance on the exhaust gas oxygen sensor response at or above the firing frequency of the cylinders to which the sensor is exposed, it is possible to isolate feedback control interactions with the monitoring function, and thereby achieve a reliable indication of imbalance. Such is the case even in the example where the sensor reading is confounded with exhaust gas from a plurality of cylinders.

DETAILED DESCRIPTION

Figure 1:
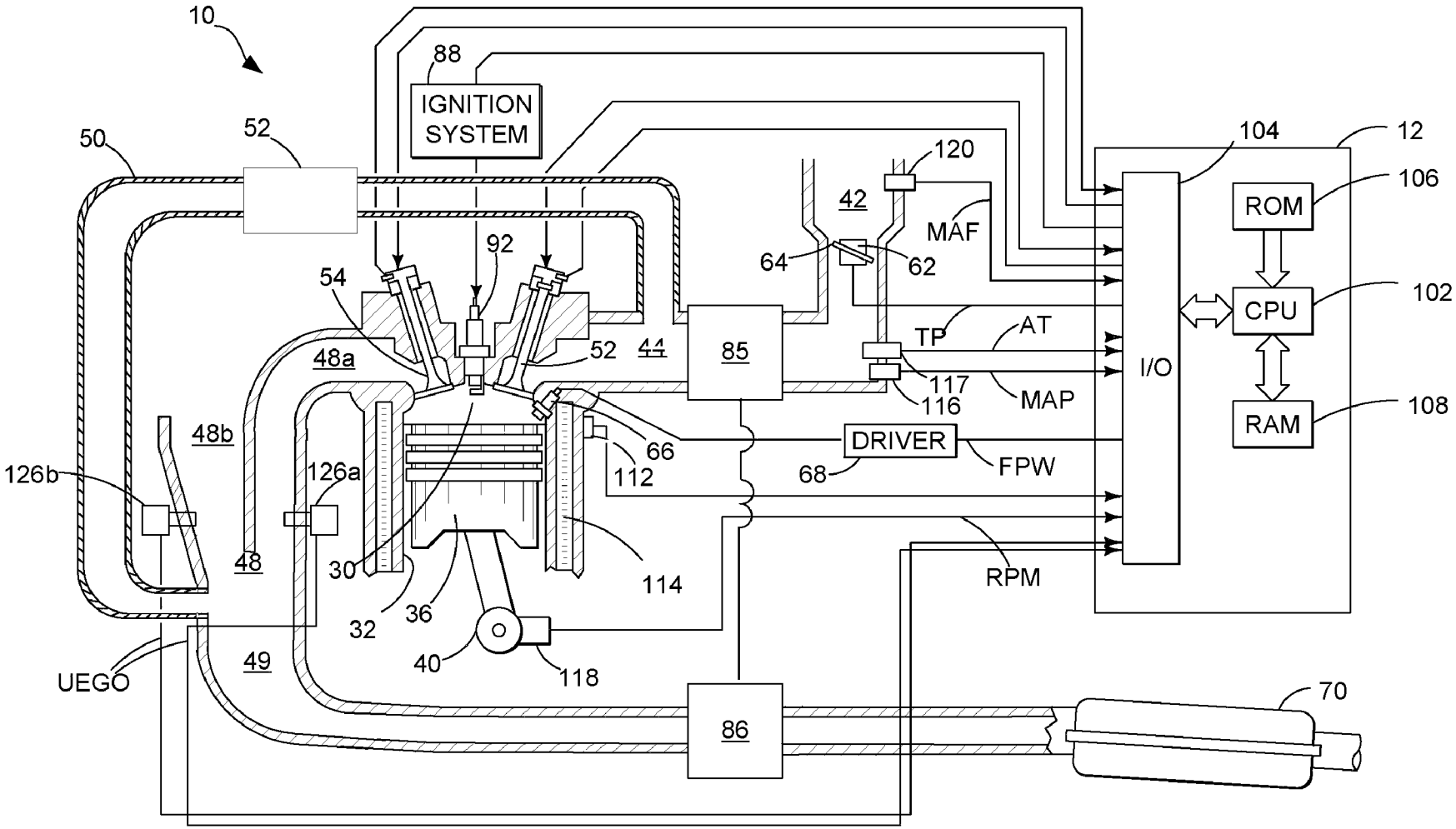
FIG. 1 is a schematic diagram of an example engine in which the disclosed system and method for monitoring air/fuel imbalance using an oxygen sensor, such as an UEGO or a HEGO sensor, may be implemented.

FIG. 1 is a schematic diagram of an example internal combustion engine 10 in which the disclosed system and method for monitoring air/fuel imbalance using an oxygen sensor, such as universal exhaust gas oxygen (UEGO) sensor or heated exhaust gas oxygen (HEGO) sensor, may be implemented. The engine 10 may be a diesel engine in one example and a gasoline engine in another example.

Engine 10 may comprise one or more engine cylinder banks (not shown), each of which may include a plurality of engine cylinders, only one cylinder of which is shown in FIG. 1. Engine 10 may include combustion chamber 30 and cylinder walls 32 with piston 36 positioned therein and connected to crankshaft 40. Combustion chamber 30 may communicate with intake manifold 44 and exhaust manifold 48 via respective intake valve 52 and exhaust valve 54. Engine 10 may be controlled by electronic engine controller 12.

Engine 10 is shown as a direct injection engine with injector 66 located to inject fuel directly into cylinder 30. Fuel is delivered to fuel injector 66 by a fuel system (not shown), including a fuel tank, fuel pump, and/or high pressure common rail system. Fuel injector 66 delivers fuel in proportion to the pulse width of signal FPW from controller 12. Both fuel quantity, controlled by signal FPW and injection timing may be adjustable. Engine 10 may utilize compression ignition combustion under some conditions, for example. Engine 10 may utilize spark ignition using a spark plug 92 of an ignition system, or a combination of compression ignition and spark ignition.

Combustion chamber 30 may receive intake air from intake manifold 44 via intake passage 42 and exhaust combustion gases via exhaust manifold 48 and exhaust passage 49. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves. Exhaust manifold 48 may include various branches, each of which communicating with an engine cylinder bank. For example and as shown in FIG. 1, exhaust manifold 48 may include a first branch 48*a* communicating with a first engine cylinder bank (not shown) of engine 10 and a second branch 48*b* communicating with a second engine cylinder bank (not shown) of engine 10. Each of the exhaust manifold branches (e.g., 48A, 48B) may further branch into additional sub-branches (shown in FIG. 2), with each of the sub-branches communicating with an individual cylinder of an engine cylinder bank.

One or more exhaust gas sensors 126 may be provided in exhaust manifold 48 and/or exhaust passage 49 for sensing contents of engine exhaust gas. Exhaust gas sensor 126 may be any suitable sensor for providing an indication of exhaust gas air/fuel ratio, such as $O_2$, NOx, HC, or CO sensor. As shown in FIG. 1, a universal oxygen sensor 126A is provided for exhaust manifold branch 48A and a universal oxygen sensor 126B is provided for exhaust manifold branch 48B.

An exhaust gas recirculation (EGR) system for recirculating exhaust air back into intake may be provided. The EGR system may include an EGR passage 50 formed from the exhaust passage 49 to the intake passage 42, and an EGR valve 52 positioned in the EGR passage 51 for regulating the EGR flow.

Emission control device 70 is shown arranged along exhaust passage 49 downstream of exhaust gas sensor 126. Device 70 may be a three way catalyst (TWC), NOx trap, various other emission control devices, or combinations thereof.

A turbocharger can be coupled to engine 10 via the intake and exhaust manifolds. The turbocharger may include a compressor 85 in the intake and a turbine 86 in the exhaust coupled via a shaft. Further, the engine 10 may include a throttle (not shown) and exhaust gas recirculation (not shown).

Controller 12 is shown in FIG. 1 as a microcomputer including: microprocessor unit 102, input/output ports 104, read-only memory 106, random access memory 108, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a measurement of manifold pressure (MAP) from pressure sensor 116 coupled to intake manifold 44; a measurement (AT) of manifold temperature from temperature sensor 117; an engine speed signal (RPM) from engine speed sensor 118 coupled to crankshaft 40.

Figure 2:
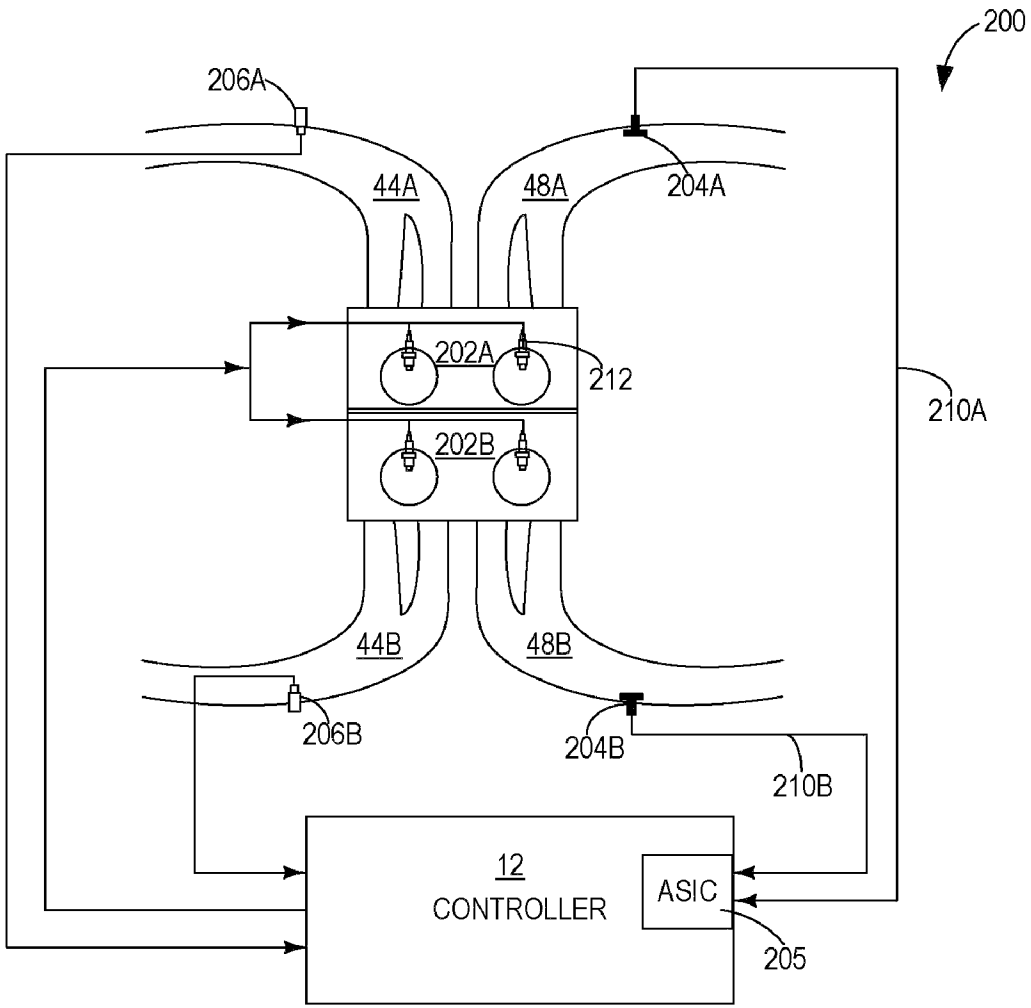
FIG. 2 is a schematic diagram of an exemplary system for monitoring air/fuel imbalance using an oxygen sensor.

FIG. 2 is a schematic diagram of an example system 200 for monitoring air/fuel ratio imbalance which may be implemented in engine 10 of FIG. 1. System 200 is shown to include two engine cylinder banks 202A, 202B, each of which including two engine cylinders. Engine 10 is shown coupled to intake manifold 44 and exhaust manifold 48. Intake manifold 44 is shown to include two branches, intake manifold branch 44A coupled to engine cylinder bank 202A and intake manifold branch 44B coupled to engine cylinder bank 202B. Exhaust manifold 48 is shown to also include two branches, exhaust manifold branch 48A coupled to engine cylinder bank 202A and exhaust manifold branch 48B coupled to engine cylinder bank 202B. Exhaust manifold branches 48A, 48B are shown to be further divided into sub-branches, each of the sub-branches communicating with and leading from an individual engine cylinder.

The system 200 may include one or more proportional oxygen sensors 204 positioned in the exhaust manifold 48. As is shown in FIG. 2, a proportional oxygen sensor 204A, 204B is provided for each branch of the exhaust manifold branches 48A, 48B for measuring oxygen concentration. The proportional oxygen sensors 204A, 204B may be located at or downstream of a first confluent point of the exhaust manifold 48 at which individual sub-branches of the exhaust manifold branches 48A, 48B that lead from individual engine cylinders gather, but upstream of a second confluent point (not shown) of the exhaust manifold 48 at which exhaust manifold branches 48A and 48B gather.

The proportional oxygen sensor 204A, 204B may be a UEGO sensor or a HEGO sensor and may be configured to detect and output a corresponding signal 210 (including 210A, 210B) that provides an indication of oxygen content of exhaust gas of engine 10 at the location of the corresponding proportional oxygen sensor 204A, 204B. The signal 210A, 210B may include a high frequency component at or above a selected frequency. that reflects air/fuel ratio of individual engine cylinders upstream of the proportional oxygen sensor 204A, 204B as they are fired in sequence. The high frequency component of signals 210A, 210B may therefore be related to cylinder-to-cylinder air/fuel ratio deviation or dispersion among individual cylinders upstream of the proportional oxygen sensor 204A, 204B and used for air/fuel ratio imbalance monitoring. For example, the signal 210A, 210B detected may include a response of the exhaust gas sensor at frequencies at or above firing frequency of the cylinders upstream of the particular exhaust gas sensor.

The system 200 may include controller 12 coupled to the proportional oxygen sensor 204 and to various other sensors and actuators of engine 10 as discussed in reference to FIG. 1 including MAF sensor 206A, 206B and fuel injectors 212. Controller 12 my include an application specific integrated circuit (ASIC) filter 205 for processing signal 210 generated by the proportional oxygen sensor 204. Signal 210 may be further processed by ASIC filter 204 prior being used for air/fuel ratio imbalance monitoring and air/fuel feedback control. Details of an example ASIC filter 205 are further illustrated in reference to FIG. 11.

The system 200 may be configured to utilize a snapshot of signal 210 detected by the proportional oxygen sensor 204, for example detected at PIP or at fixed 8 ms rate for monitoring air/fuel ratio imbalance of the internal combustion engine. Further, a single proportional oxygen sensor may be used for both monitoring air/fuel ratio imbalance due to cylinder-to-cylinder air/fuel variation and providing air/fuel feedback control for a plurality of engine cylinders, such as an engine cylinder bank. Further details of an example air/fuel monitoring and air/fuel feedback control are further illustrated in reference to FIGS. 3 & 4. It should be noted that it is also possible to use the system 200 to get more accurate monitor of the air/fuel imbalance without adjusting air/fuel control.

As will be appreciated by one skilled in the art, the specific routines described below in the flowcharts may represent one or more of any number of processing strategies such as event-driven, interrupt-driven, multi-tasking, multi-threading, and the like. As such, various acts or functions illustrated may be performed in the sequence illustrated, in parallel, or in some cases omitted. Likewise, the order of processing is not necessarily required to achieve the features and advantages, but is provided for ease of illustration and description. Although not explicitly illustrated, one or more of the illustrated acts or functions may be repeatedly performed depending on the particular strategy being used. Further, these Figures graphically represent code to be programmed into the computer readable storage medium in controller 12.

Figure 3:
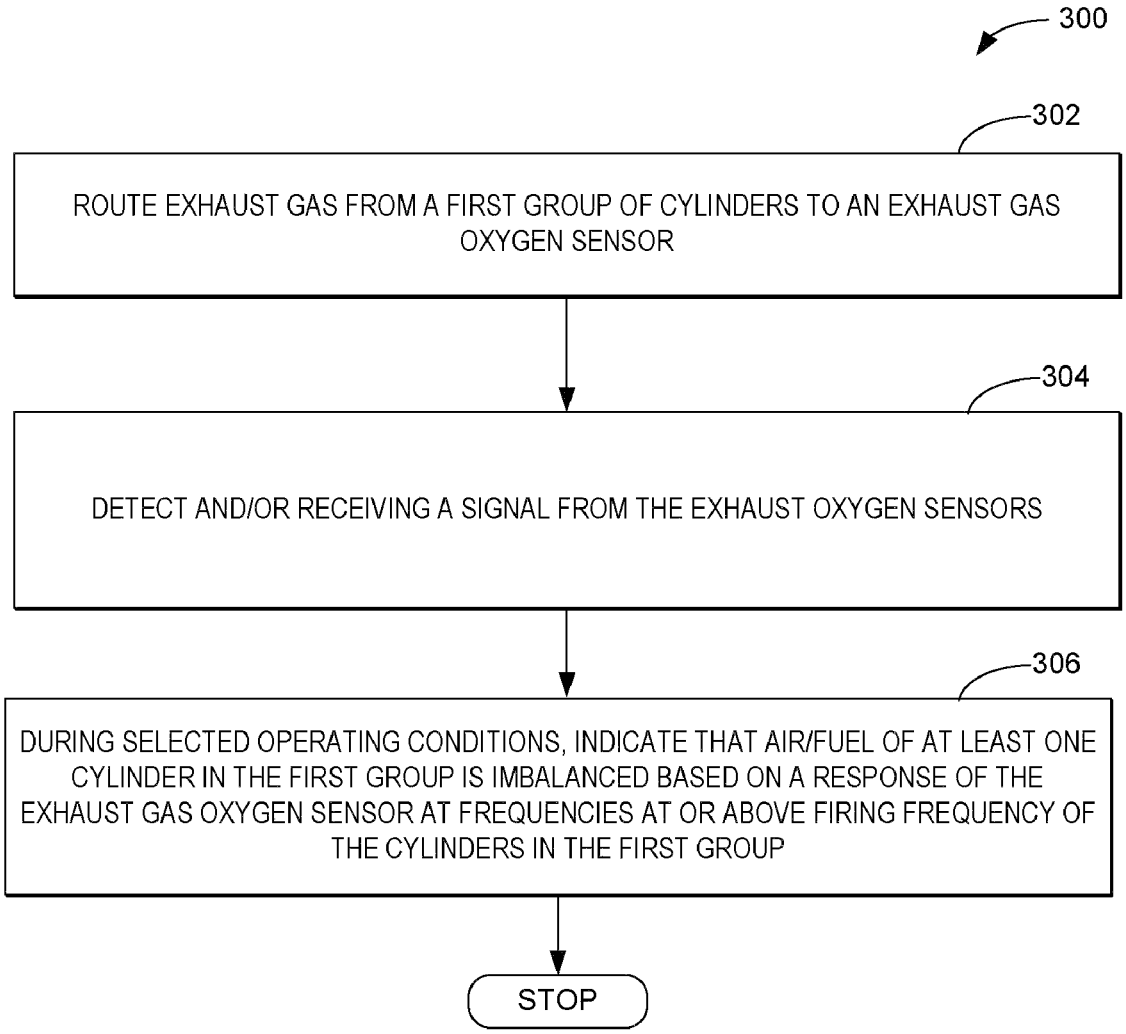
FIG. 3 is a high level flowchart for an exemplary method for monitoring air/fuel imbalance using an exhaust gas oxygen sensor.

FIG. 3 is a high level flowchart of a method or process 300 for monitoring air/fuel ratio imbalance of an internal combustion engine (e.g., 10) using an exhaust gas sensor, such as a proportional oxygen sensors (e.g., 204A or 204B) positioned in an exhaust manifold (e.g., 48) of the internal combustion engine (e.g, 10).

The process 300 may be implemented in the system 200 of FIG. 2. For example, the controller 12 may include one or more of hardware and/or software that are configured to implement the exemplary process 300.

At 302, the method may include routing exhaust gas from a group of cylinders to the exhaust gas sensor. The exhaust gas sensors may be positioned in such a way so that exhaust gas from a group of cylinders, such as a group of cylinders in an engine cylinder bank, upstream of the exhaust gas sensor, are routed to the exhaust gas sensor. In one example, exhaust gas from only a sub-set of the engine cylinders is routed to the sensor. For example, the exhaust gas sensor may be positioned at or downstream of a confluent point of the exhaust manifold where sub-branches of the exhaust manifold leading from individual cylinders of a corresponding engine cylinder bank of the internal combustion engine gather, but upstream of a confluent point of the exhaust manifold where branches of the exhaust manifold leading from individual engine cylinder banks gather. In this way, only the exhaust gas from a corresponding group of cylinders may be routed to an exhaust gas sensor.

At 304, the method may include detecting and/or receiving a signal from the exhaust oxygen sensors.

The signal detected for each of the exhaust gas sensors may include a response of the exhaust gas sensor at or above a selected frequency. The detected signal may reflect air/fuel ratio of individual cylinders of the engine cylinder bank as the individual cylinders of that bank fire consecutively, and may be related to cylinder-to-cylinder air/fuel ratio dispersion of the cylinders in the engine cylinder bank. For example, the signal detected may include a response of the exhaust gas sensor at frequencies at or above firing frequency of the cylinders upstream of the particular exhaust gas sensor.

At 306, during selected operating conditions, indicating that air/fuel of at least one cylinder in the group of cylinders is imbalanced based on a response of the exhaust gas sensor at frequencies at or above firing frequency of the cylinders in the group. The method may determine a high frequency component of the proportional oxygen sensor response that is related to cylinder-to-cylinder air/fuel ratio deviation or dispersion.

In one example, the method may track the magnitude of the hash, which is a differential signal between consecutive samples of the detected signal, when a pre-calibrated entry condition that includes selected operating conditions is met. The hash may also be referred to as a high frequency differential signal. If the difference in consecutive samples is greater than an air mass-based threshold function, then the routine may integrate the differences over a selected number of engine revolution cycles, such as 100 engine revolution cycles to give an integrated difference over an engine revolution window. The integrated difference over an engine revolution window may be compared with a threshold value to indicate a failed engine revolution window if the integrated difference is greater than threshold value. The threshold value may further vary with the level of engine airflow. The method may repeat the above procedures for a calibratable number of engine revolution window, such as 25 engine revolution windows. The method may then calculate an air/fuel imbalance monitor (AFIM) ratio based on a ratio of number of failed engine revolution windows to total number of engine revolution windows monitored. Further, the method may then indicate that air/fuel of at least one cylinder of the group of cylinders is imbalanced if the AFIM ratio is above a threshold value.

The pre-calibrated entry condition may be engine rotation speed dependent and may be configured to reduce transient air/fuel variations due to transient engine operating conditions, such as purge spikes or refueling (low fuel) events and thereby enable improved air/fuel ratio imbalance monitoring on a per engine bank basis.

For example, the pre-calibrated entry condition may include whether the engine is not in adaptive air fuel learning, the engine is operating within a prescribed engine rotation speed range, fuel-fraction (e.g., ethanol fraction) is within a prescribed range, EGR is within a selected range, the engine is not performing close loop fuel feedback control, throttle position is within a prescribed range, and/or fuel sensor does not indicate that the engine is low in fuel. When each of the above conditions is present, the air-fuel imbalance may be monitored.

In some examples, the method may include determining the direction of the air/fuel ratio imbalance shift. For example, it may include indicating whether the air/fuel ratio imbalance is leaning towards fuel lean or fuel rich, by comparing a commanded air/fuel (e.g., LAMBSE value) over registered or detected air/fuel ratio detected by the proportional oxygen sensor, and accumulating the shift or deviation in air/fuel ratio over the specific entry conditions.

In some examples, the method may include suspending determination whether the air/fuel ratio is imbalanced, if the difference and/or ratio of the commanded air/fuel (e.g., LAMBSE value) over the measured air/fuel ratio measured by the proportional oxygen sensor is not over a predetermined threshold and falls into a predetermined dead band range, even if the integrated cylinder-to-cylinder air/fuel deviation exceeds a predetermined threshold value.

Figure 4A:
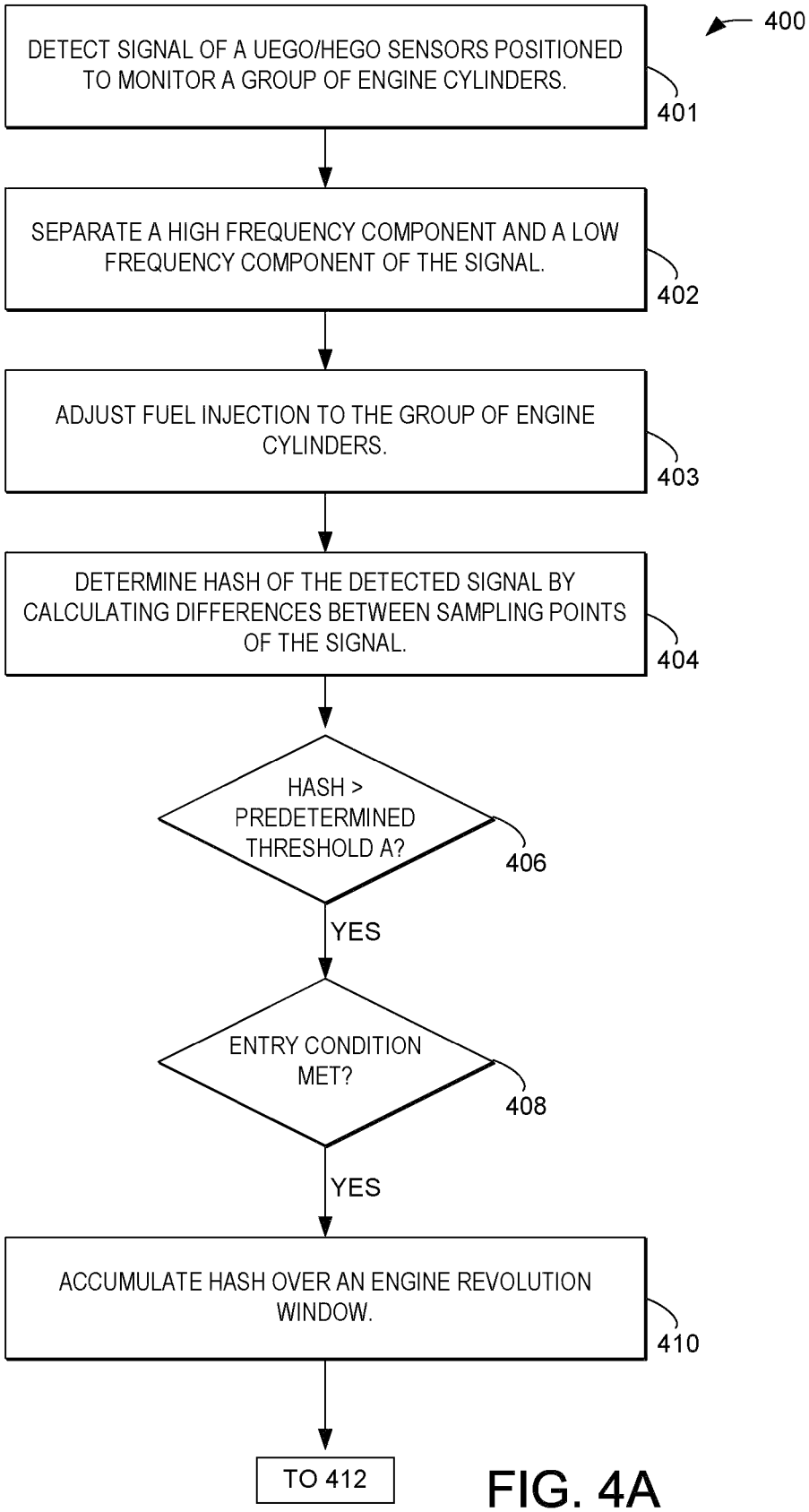
FIG. 4 is a flowchart of an additional exemplary method for monitoring air/fuel imbalance using an exhaust gas oxygen sensor.
Figure 4B:
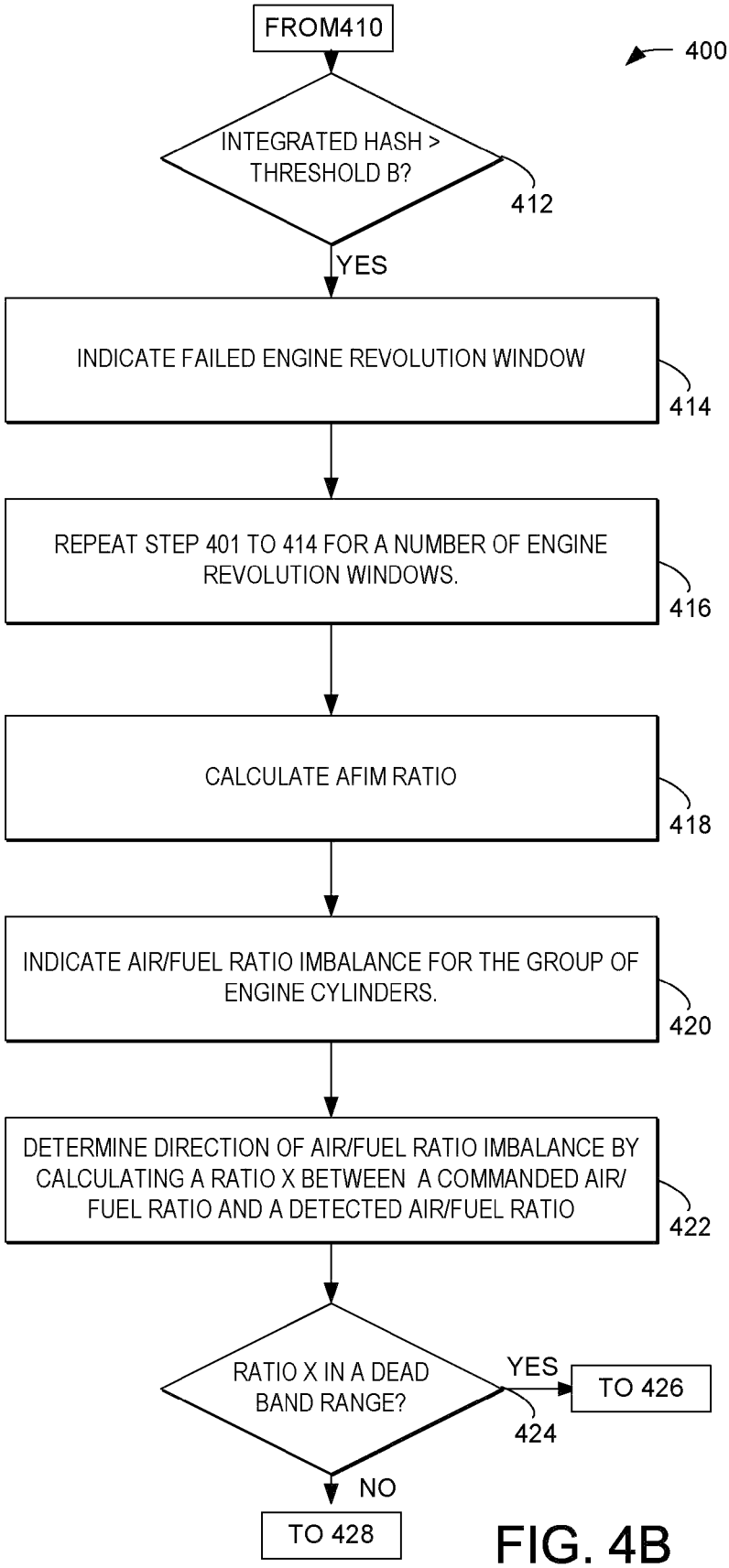
Figure 4C:
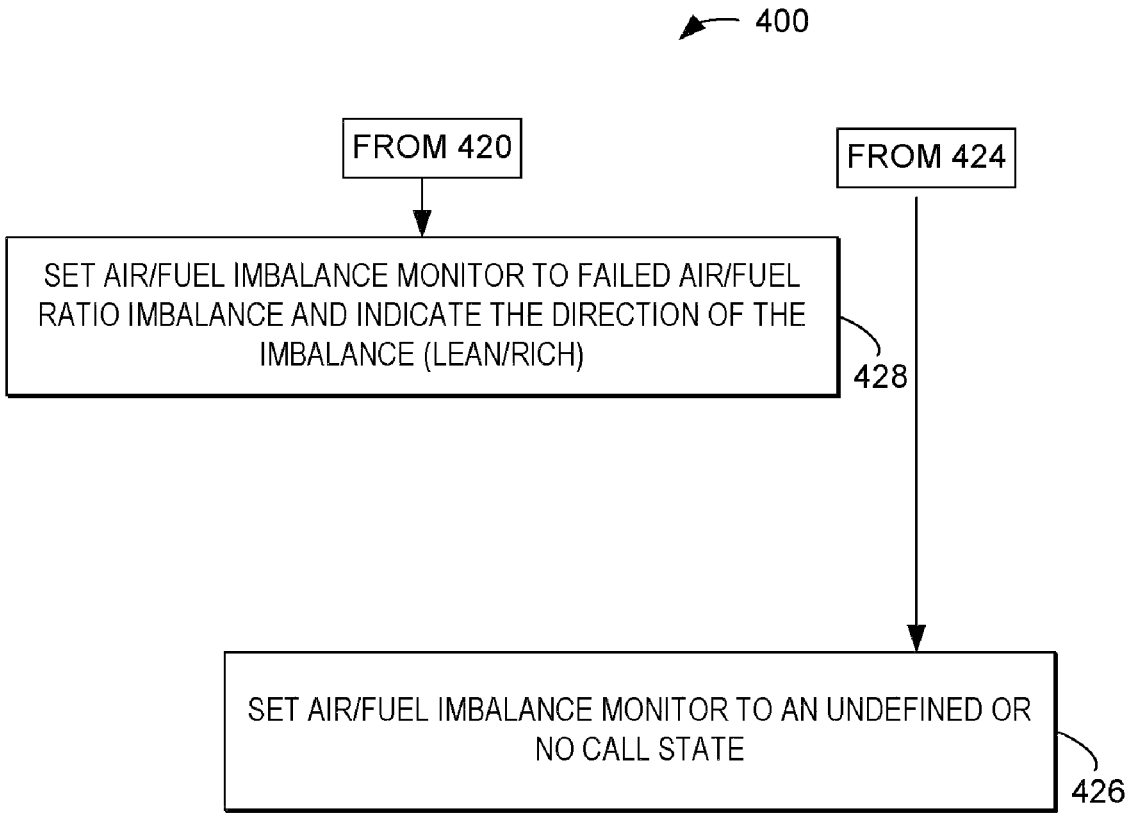

FIG. 4 is a flowchart of a more detailed exemplary method or process 400 for using one or more UEGO/HEGO sensors (e.g., 204A, 204B) for monitoring air/fuel ratio imbalance of an engine. Each of the UEGO/HEGO sensors may be positioned to receive exhaust gas from and monitor air/fuel ratio imbalance of a group of engine cylinders, such as a group of engine cylinders of an engine cylinder bank, upstream of the UEGO/HEGO sensor. The method 400 may be implemented in the system 200 of FIG. 2.

The method 400 may utilize a separate UEGO/HEGO sensor for monitoring air/fuel imbalance and/or for providing air/fuel feedback control of a corresponding group of engine cylinders. For example, the method may utilize a first UEGO/HEGO sensor positioned downstream of a first group of engine cylinders for monitoring air/fuel imbalance and for providing air/fuel feedback control of the first group of cylinders independent of other group(s) of engine cylinders, and a second UEGO/HEGO sensor positioned downstream of a second group of engine cylinders for monitoring air/fuel imbalance and for providing air/fuel feedback control of the second group of engine cylinders independent of other group (s) of engine cylinders.

The method 400 may include for each of the UEGO/HEGO sensors positioned to monitor a corresponding group of engine cylinders:

At 401, the method detects a signal of the UEGO/HEGO sensor at PIP (RPM related profile ignition pickup) or at a fixed 8 ms rate.

Figure 11:
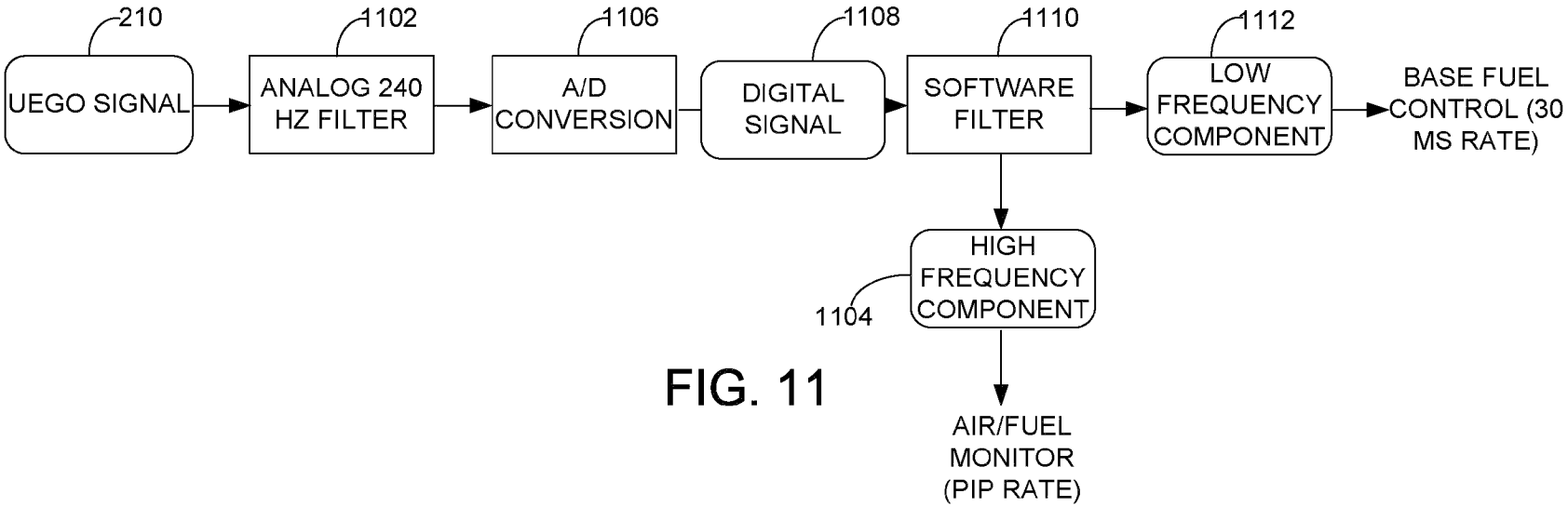
FIG. 11 is a schematic diagram of filter employed in a system and method for monitoring air/fuel ratio imbalance.

At 402, the routine separates a higher frequency component and a lower frequency component of the signal, details of which are further illustrated in reference to FIG. 11.

The higher frequency component of the response of the HEGO/UEGO sensor may include frequencies at or above firing frequencies of the group of cylinders upstream of the HEGO/UEGO sensor, and the lower frequency component of the response of the HEGO/UEGO sensor may include frequencies at or below firing frequencies of the group of cylinders upstream of the HEGO/HEGO.

The lower frequency component of the signal is further processed in 403 and the higher frequency component of the signal is further processed in 404

At 403, the method includes adjusting fuel injection to the group of cylinders upstream of the HEGO/UEGO sensor based on the lower frequency component. Adjusting the fuel injection to the group of cylinders may be independent of the high frequency component of the signal of the HEGO/UEGO sensor.

At 404, the method includes determining the "hash" of the UEGO/HEGO sensor signal by calculating differences between sampling points of the signal, such as between consecutive samples of the signal. For example, differences between consecutive samples of the signal (that correspond to oxygen content of different engine cylinders that are fired in sequence) may be calculated to determine the "hash" between consecutive samples of the high frequency UEGO/HEGO sensor signal.

At 406, the method includes determining whether the hash is above a predetermined threshold A. If the answer is yes, the method proceeds to step 408. The predetermined threshold A may be a function of engine air flow, measured for example by the mass air flow meter.

At 408, the method includes determining if a predetermined or pre-calibrated entry condition is met. The pre-calibrated entry condition may be engine rotation speed dependent and/or may includes various parameters to reduce transient air/fuel effects, or various other entry conditions such as those noted herein. If the answer is yes, the method proceeds to 410.

At 410, the method includes accumulating or integrating the hash over an engine revolution window to obtain a window based integrated hash value. By obtaining an engine revolution window based integrated hash, and by limiting the number of engine revolutions of the engine revolution window, and by setting a predetermined entry condition for the integration, it may be possible reduce transient effects on cylinder imbalance identification.

At 412, the method includes determining whether the window based integrated hash is above a predetermined threshold B. If the answer is yes, the method proceeds to 414. At 414, the method includes indicating and/or counting a failed engine revolution window due to higher than normal air/fuel ratio cylinder-to-cylinder variation. At 416, the method includes repeating steps 401 to 414 for a predetermined number of engine revolution windows, such as 25 engine revolution windows. At 418, the method includes calculating an air/fuel imbalance monitor (AFIM) ratio, which is equal to a ratio of failed windows over total number of engine revolution windows monitored. At 420, the method includes determining that the air/fuel ratio is imbalanced for the plurality of engine cylinders of the engine cylinder bank upstream of the UEGO/HEGO sensor if the AFIM ratio is above a predetermined threshold C. In one example, the predetermined threshold may range from 0.7 to 0.9.

At 422, the method includes determining the direction of the air/fuel ratio imbalance by comparing a commanded air/fuel ratio (e.g., LAMBSE) with a detected air/fuel ratio detected for example by the UEGO/HEGO sensor. If the air/fuel ratio detected is richer in fuel than the commanded air/fuel ratio, the air/fuel ratio imbalance is leaning towards fuel rich. On the other hand, if the air/fuel ratio detected is leaner in fuel than the commanded air/fuel ratio, the air/fuel ratio imbalance is leaning towards fuel lean.

At 424, the method includes determining whether the commanded air/fuel in comparison with the measured air/fuel ratio falls into a predetermined dead band range. If yes, the method proceeds to 426, if no, the method proceeds to 428.

At 426, the method includes setting the air/fuel imbalance monitor to an undefined or no call state.

At 428, the method includes setting air/fuel imbalance diagnostic code to indicate a sufficiently degraded air/fuel ratio imbalance for the corresponding group of engine cylinders upstream of and monitored by the UEGO/HEGO sensor.

Figure 5:
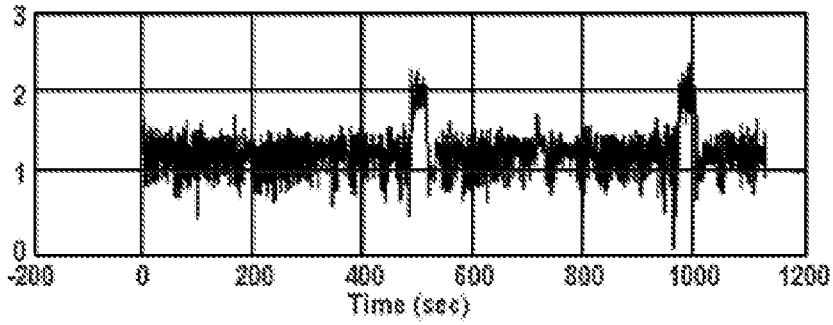
FIG. 5 plots an example high frequency UEGO sensor signal.

FIG. 5 illustrates an example high frequency UEGO sensor signal 500 obtained by a UEGO sensor (e.g., 204A or 204B). The high frequency UEGO sensor signal 500 is shown to include a high frequency component, with each peak of the high frequency component reflecting air/fuel ratio of a corresponding engine cylinder upstream of the UEGO sensor as it is fired. The high frequency component of the signal 500 may be at frequencies at or above firing frequency of the cylinders upstream of the UEGO sensor.

Figure 6:
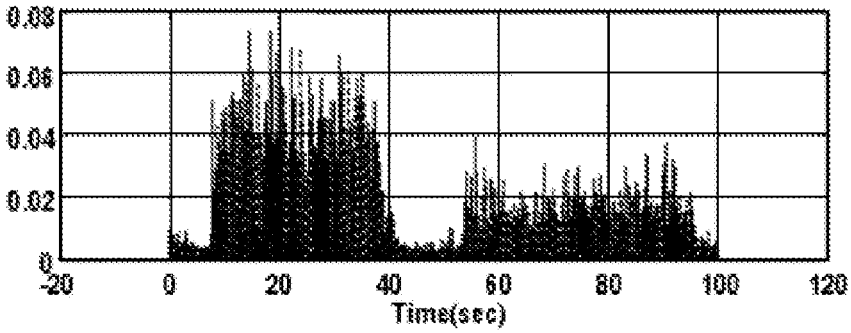
FIG. 6 plots a high frequency signal response of the linear UEGO signal of FIG. 5, the signal response being obtained by taking a difference between two consecutive samples of the linear UEGO signal of FIG. 5.

FIG. 6 plots hash of the linear UEGO signal of FIG. 5, with the hash being obtained by taking a difference between two consecutive samples of the linear UEGO signal of FIG. 5.

Figure 7:
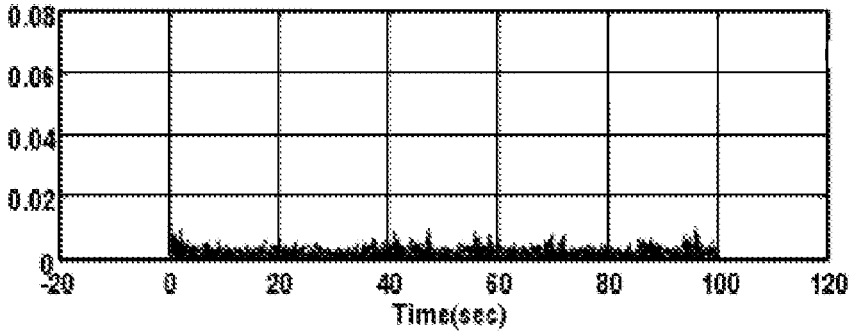
FIG. 7 plots an air mass-based threshold function that may be applied to the response shown in FIG. 6.
Figure 8:
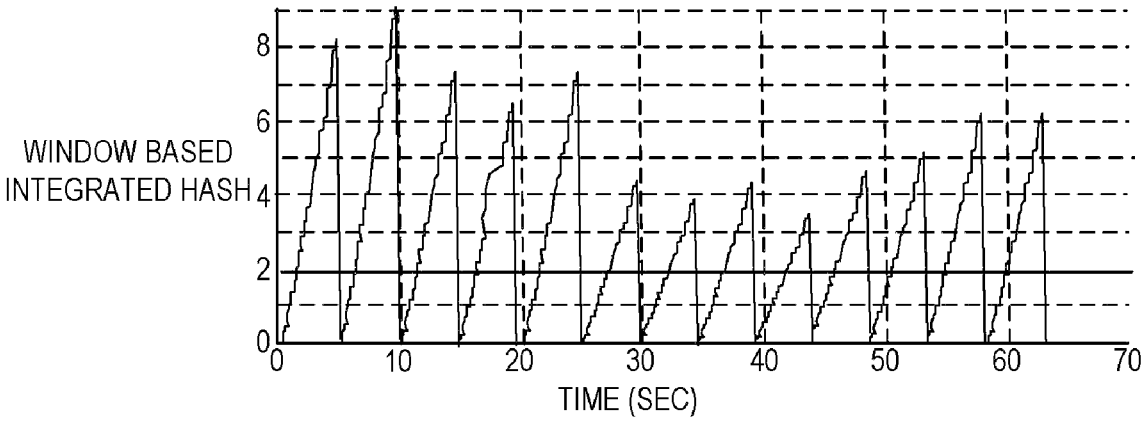
FIG. 8 plots a window based integrated response of FIG. 5, integrated over an engine revolution window (100 engine revolutions).

FIG. 7 plots an air mass-based threshold function that may be applied to the hash of FIG. 6. Hash above the threshold may be integrated over an engine revolution window, which includes 100 engine revolutions in this example, to obtain a window based and integrated hash shown in FIG. 8.

Figure 9:
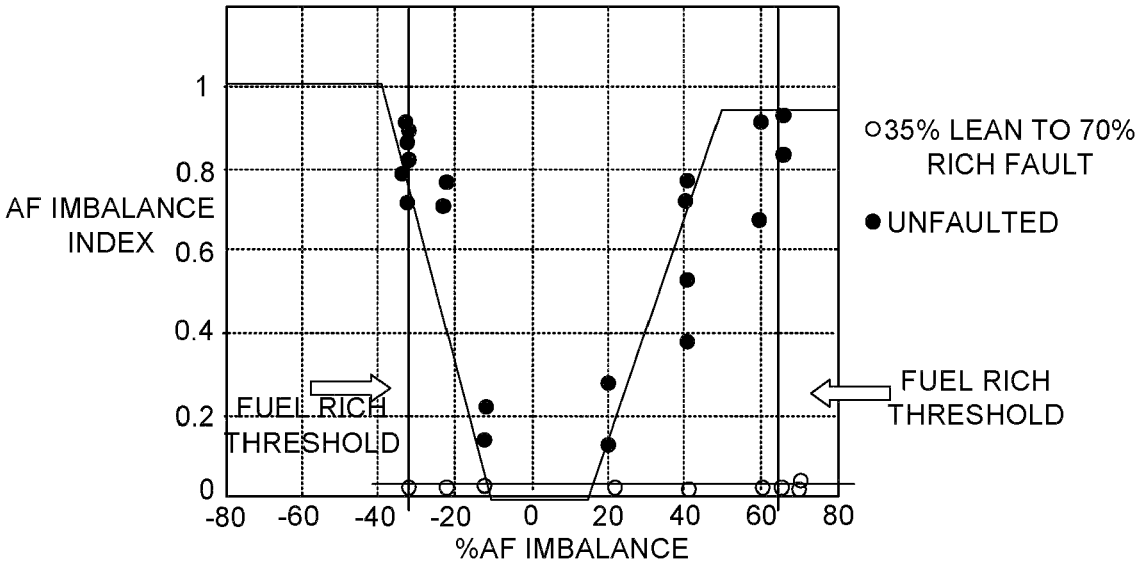
FIG. 9 plots air/fuel imbalance monitor (AFIM) ratio as a function of percentage of air/fuel imbalance for a first engine cylinder bank of a test engine.
Figure 10:
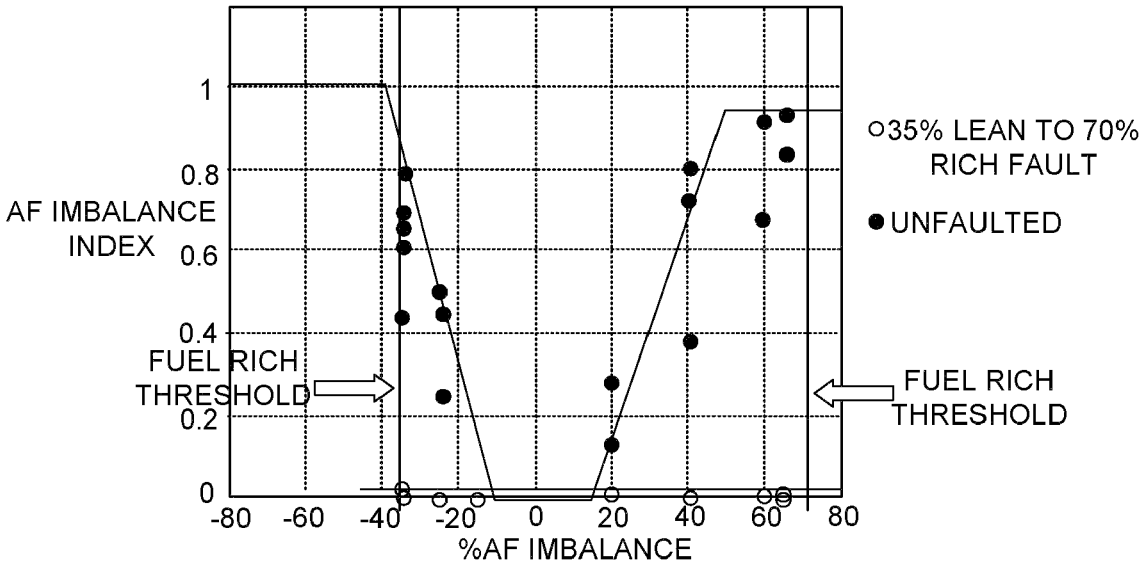
FIG. 10 plots air/fuel imbalance monitor (AFIM) ratio as a function of percentage of air/fuel imbalance for a second engine cylinder bank of the test engine of FIG. 9.

FIG. 9 plots air/fuel imbalance monitor (AFIM) ratio as a function of percentage of air/fuel imbalance for engine cylinder bank one of a test engine, while FIG. 10 plots air/fuel imbalance monitor (AFIM) ratio as a function of percentage of air/fuel imbalance for engine bank two of the same test engine of FIG. 9. These Figures show example operation for an example engine.

FIG. 11 is a schematic diagram of a signal processing block diagram which may be included in controller 12 of engine 10 for processing signal 210 detected by a proportional oxygen sensor 204. In one example, the signal processing may be implemented via ASIC 205.

The system may include a high frequency analog filter 1102, such as a 240 Hz analog filter, for smoothing signal 210 received from a proportional oxygen sensor (e.g., 204A, 204B) while preserving the high frequency component 1104 (illustrated in FIG. 12) of signal 210.

The system may further include an A/D converter 1106 for sampling and converting the signal 210 to a digital signal 1108 that includes a plurality of sampling points.

In some examples, the filtering rate of the high frequency analog filter 1102 and the sampling rate of the A/D converter 1106 may be set according to engine rotation speed so that it is frequent enough to allow air/fuel ratio variation between individual engine cylinders to be observed, at least up to a selected maximum engine speed, above which monitoring is disabled. In this way, the controller for processing the UEGO/HEGO sensor signal receives adequate information to determine air/fuel imbalance, yet not overwhelmed with an excessive amount of data. Further, in one example, the maximum engine speed below which imbalance monitoring is enabled may be adjusted based on a number of cylinders in a group monitored by an air-fuel sensor, and the total number of cylinders in the engine.

In one example, the sampling rate may be set to be a minimum of one sampling point per cylinder firing. In another example, the sampling rate may be set to be two sampling points per cylinder firing. In one specific example, a V8 engine with 4 cylinders per engine cylinder bank having a 3500 rpm having two sampling points per cylinder firing may require a sampling rate of every 4 ms, calculated as follows:

$$\begin{aligned} SamplingRate &= CylinderFiringfrequency \times \\ &\quad SamplingPointsPerCylinderFiring \\ &= 4\,\text{Cylinder} \times 3500\frac{rev}{\text{min}} \times \frac{1\frac{CylinderFiring}{\text{Cylinder}}}{2rev} \times \\ &\quad \frac{1\ \text{min}}{60\ \text{sec}} \times 2SamplingPointPerCylinderFiring \\ &= 240SamplingPointsPerSecond \end{aligned}$$

$$SamplingFrequency = 1/240SamplingPointPerSecond = 240\ \text{Hz}$$

The controller may also include a low frequency filter 1110, such as a 10 Hz digital filter software, for filtering out the high frequency component 1104 of the signal 210 to obtain a low frequency component 1112 (illustrated in FIG. 12) of the signal 210. The low frequency component of signal 210 may represent an average air/fuel ratio of engine cylinders upstream of the proportional oxygen sensor and may be used for air/fuel feedback control.

In operation, the high frequency analog filter 1102 receives signal 210 from a proportional oxygen sensor (e.g., 204A, 204B) and operates to smooth the signal 210 while preserving the high frequency component 1104 of the signal 210 that is related to air/fuel ratio deviation of engine cylinders upstream of the proportional oxygen sensor. The signal 210 is then passed to an A/D converter 1106, which samples and converts the signal 210 to a digital signal 1108. The digital signal 1108 may be used for air/fuel ratio imbalance monitoring. The digital signal 1108 may also be passed to the low frequency filter 1110 for reducing the high frequency component 1104 of signal 210 to obtain the low frequency component 1112 of signal 1102, which may be used for air/fuel ratio feedback control.

Figure 12:
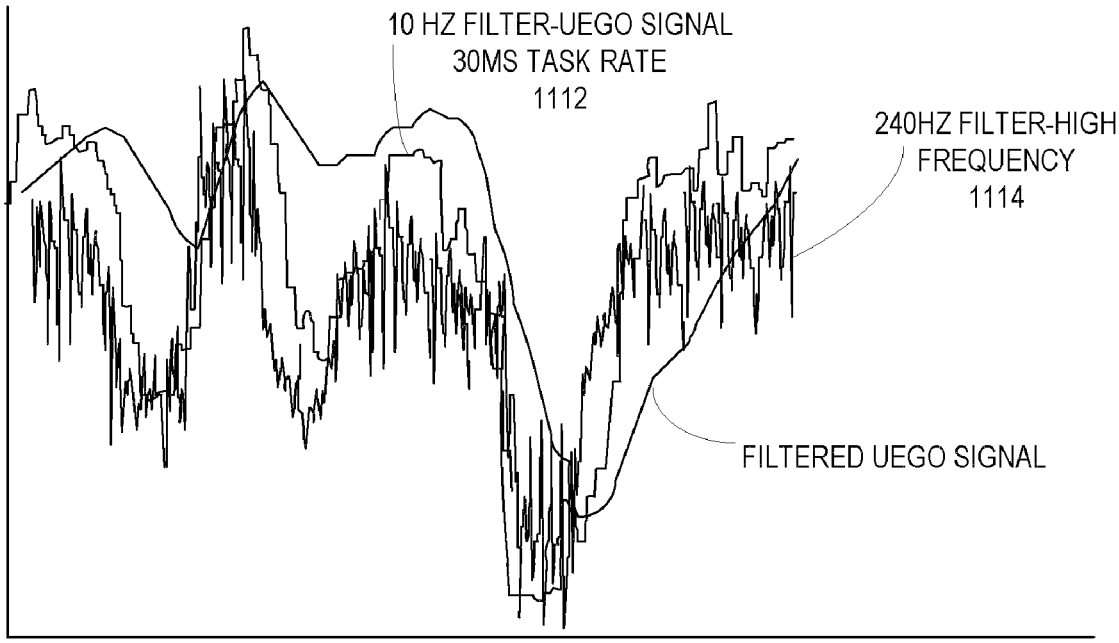
FIG. 12 compares the high frequency component and the low frequency component of the linear UEGO sensor signal processed using the ASIC filter of FIG. 11.

FIG. 12 compares a low frequency component 1112 of the linear UEGO sensor signal 210 with the high frequency component 1104 of the linear UEGO sensor signal 210 of FIG. 11.

Figure 13:
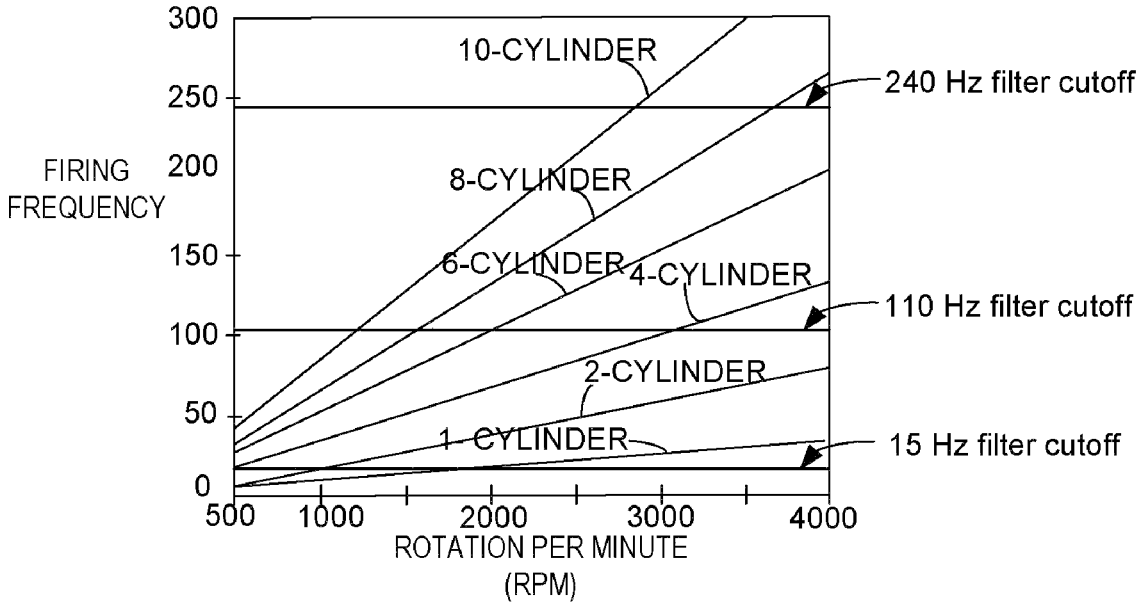
FIG. 13 illustrates firing frequency as a function number of cylinders and engine rotation speed.

FIG. 13 illustrates firing frequencies of a set of cylinders that include one, two four, six, eight or ten cylinders as a function of engine rotation speed, compared to a 240 Hz ASIC filter cutoff. The cylinder firing frequency is calculated using the following equation:

$$\text{Freq}=\#\text{Cyl}*N/(2\times 60)$$

where #Cyl is the number cylinder in a group of cylinders upstream of the exhaust gas oxygen sensor used for monitoring air/fuel ratio imbalance of the group of cylinders, and N is engine rotation speed. As noted herein, monitoring for cylinder imbalances may be enabled based on whether engine speed is below a threshold maximum engine speed. As shown in FIG. 13, the maximum speed may be selected based on the number of engine cylinders and such that sufficiently high frequency digital sampling is obtained to accurately identify cylinder-cylinder variations without aliasing of the signal down to lower frequencies.

It will be appreciated that the configurations and routines disclosed herein are exemplary in nature, and that these specific embodiments are not to be considered in a limiting sense, because numerous variations are possible.

The subject matter of the present disclosure includes all novel and nonobvious combinations and subcombinations of the various systems and configurations, and other features, functions, and/or properties disclosed herein. For example, once the pressure based measurement becomes available, it may be possible to adaptively update the model based on a comparison of the incremental soot load previously obtained while the pressure based measurement was unavailable.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

We claim:

1. A method for monitoring air/fuel of an engine, comprising:

routing exhaust gas from a group of cylinders to an oxygen sensor; and sampling the oxygen sensor above a firing frequency of the group of cylinders;

determining a difference between the samples over a window interval; and indicating an air/fuel imbalance in the group of cylinders when a ratio of at least the window interval over a total number of window intervals exceeds a threshold.

2. The method of claim 1, wherein the indication is made when engine airflow is greater than a predetermined threshold.

3. The method of claim 1, further comprising correlating a magnitude of a response of the oxygen sensor at or above the firing frequency to the air/fuel imbalance when the magnitude is greater than a threshold, and where the threshold varies with a level of airflow.

4. The method of claim 3, where during selected conditions when engine speed is less than an upper limit, said upper limit is based on a number of cylinders in the group of cylinders, indicating that air/fuel of at least one cylinder is imbalanced based on sampling the oxygen sensor.

5. The method of claim 1, where the group of cylinders is a first group of cylinders and includes only cylinders on one bank of a dual bank engine.

6. The method of claim 5, where a response of the oxygen sensor is monitored over a limited number of engine cycles.

7. The method of claim 5, further comprising:

routing exhaust gas from a second group of cylinders to a second oxygen sensor; and during selected operating conditions, indicating that at least one cylinder air/fuel in the second group is imbalanced based on a response of the second oxygen sensor at frequencies at or above a firing frequency of cylinders in the second group, and where the exhaust gas from the second group reaches the second oxygen sensor without mixing with the exhaust gas from the first group.

8. The method of claim 1, further comprising adjusting fuel injection to the group of cylinders based on a response of the oxygen sensor at frequencies below the firing frequency of the cylinders in the group of cylinders, where the fuel injection to the group of cylinders is independent from the response of the oxygen sensor at frequencies at or above the firing frequency of the cylinders in the group of cylinders.

9. The method of claim 7, further comprising setting a first diagnostic code for the first group of cylinders in response to the indicated air/fuel imbalance of the first group, and setting a second, separate, diagnostic code for the second group of cylinders in response to the indicated air/fuel imbalance of the second group of cylinders.

10. A system for monitoring air/fuel ratio imbalance of an internal combustion engine having a first group of engine cylinders and a second group of engine cylinders, comprising:

a first exhaust gas oxygen sensor coupled downstream of, and receiving exhaust gas from, only the first group of engine cylinders; and a controller configured to, during selected operating conditions including when engine speed is below a threshold speed, sample an oxygen sensor signal above a firing frequency of said first group of engine cylinders, separate higher frequencies from the oxygen sensor signal forming a high frequency oxygen sensor signal, determine a difference between samples of the high frequency oxygen sensor signal, indicate that air/fuel of at least one cylinder in the first group is imbalanced based on the high frequency oxygen sensor signal, and adjust fuel injection to the first group based on the high frequency oxygen sensor signal.

11. The system of claim 10, wherein the controller is further configured to indicate the air/fuel imbalance when engine airflow is greater than a predetermined threshold.

12. The system of claim 11, wherein the controller is further configured to correlate a response of the first exhaust gas oxygen sensor at or above the firing frequency to the air/fuel imbalance when a magnitude of the response is greater than a threshold, and where the threshold varies with a level of airflow.

13. The system of claim 12, wherein the selected operating conditions include when engine speed is less than an upper limit, where said upper limit is based on a number of cylinders in the first group of cylinders.

14. The system of claim 10, wherein the first group of cylinders includes only cylinders on one bank of a dual bank engine.

15. The system of claim 14, wherein the controller is further configured to monitor a response of the first exhaust gas oxygen sensor over a limited number of engine cycles.

16. The system of claim 10, wherein the system further includes:

a second exhaust gas oxygen sensor positioned in such a way that exhaust gas from the second group of engine cylinders is routed to the second exhaust gas oxygen sensor; and wherein the controller is further configured to, during selected operating conditions, indicate that at least one cylinder air/fuel in the second group is imbalanced based on a response of the second exhaust gas oxygen sensor at frequencies at or above a firing frequency of the cylinders in the second group, where the first group of cylinders is separate from the second group of cylinders, and where the exhaust gas from the second group reaches the second exhaust gas oxygen sensor without mixing with the exhaust gas from the first group.

17. The system of claim 10, where fuel injection to the first group is independent from a response of the oxygen sensor at frequencies at or above the firing frequency of the cylinders in the first group.

18. The system of claim 17, wherein the controller is further configured to set a first diagnostic code for the first group of cylinders in response to the indicated air/fuel imbalance of the first group, and setting a second, separate, diagnostic code for the second group of cylinders in response to an indicated air/fuel imbalance of the second group.

19. The system of claim 18, wherein the controller further comprises an ASIC filter for separating out a high frequency component of the oxygen sensor signal for air/fuel ratio imbalance monitoring and a low frequency component for air/fuel feedback control.

20. A method for monitoring air/fuel ratio imbalance of an internal combustion engine having one or more engine cylinder banks, each of the one or more engine cylinder banks including a plurality of engine cylinders and a proportional oxygen sensor positioned at or downstream of a confluent point of an exhaust manifold of the internal combustion engine where various sub-branches of the exhaust manifold leading from individual engine cylinders of the plurality of engine cylinders gather but upstream of a confluent point where branches of the exhaust manifold leading from individual engine cylinder banks gather, the method comprising:

receiving a signal detected by the proportional oxygen sensor, the signal containing a high frequency component that is related to cylinder-to-cylinder air/fuel ratio dispersion among the plurality of engine cylinders;

determining the high frequency component of the signal that is related to cylinder-to-cylinder air/fuel ratio dispersion among the plurality of engine cylinders, which includes determining a hash of the first signal by taking a difference between consecutive samples of the signal and producing a difference signal;

determining air/fuel ratio imbalance of the internal combustion engine based on the high frequency component of the signal, which includes comparing the difference signal with a predetermined threshold, integrating the difference signal over an engine revolution window that includes 100 engine revolutions to obtain an integrated difference signal if the difference signal is beyond the predetermined threshold, recording a failed engine revolution window with air/fuel ratio imbalance if the integrated difference signal is beyond a second predetermined threshold, determining an air/fuel ratio imbalance index based on a fraction of failed engine revolution windows out of a total number of engine revolution windows monitored, and indicating a detected air/fuel ratio imbalance for the plurality of engine cylinders if the air/fuel ratio imbalance index is greater than the second predetermined threshold; and determining whether the detected air/fuel ratio imbalance is leaning towards fuel rich or fuel lean based on a comparison of the signal and a commanded air/fuel ratio.

* * * * *

UNITED STATES PATENT AND TRADEMARK OFFICE

CERTIFICATE OF CORRECTION

PATENT NO. : 7,802,563 B2
APPLICATION NO. : 12/055111
DATED : September 28, 2010
INVENTOR(S) : Ken John Behr et al.

It is certified that error appears in the above-identified patent and that said Letters Patent is hereby corrected as shown below:

On the title page, item [73]: (Assignee) of the patent face, delete "Fors" and insert --Ford-- therefore.

Signed and Sealed this

Twenty-third Day of November, 2010

David J. Kappos

David J. Kappos
*Director of the United States Patent and Trademark Office*